United States Patent [19]

Botta et al.

[11] Patent Number: 5,059,391

[45] Date of Patent: Oct. 22, 1991

[54] USE OF POLYARALKYLAMINES AS CORROSION INHIBITORS

[75] Inventors: Artur Botta, Krefeld; Christian Wegner, Cologne; Heinz-Joachim Rother, Krefeld, all of Fed. Rep. of Germany

[73] Assignee: Bayer Aktiengesellschaft, Leverkusen, Fed. Rep. of Germany

[21] Appl. No.: 239,480

[22] Filed: Sep. 1, 1988

[30] Foreign Application Priority Data

Sep. 11, 1987 [DE] Fed. Rep. of Germany ..... 3730475

[51] Int. Cl.[5] ..... C23F 11/14

[52] U.S. Cl. ..... 422/7; 422/12; 422/13; 422/16; 252/390; 544/402; 546/229; 546/246; 564/323; 564/367; 564/368; 564/369; 564/370

[58] Field of Search ..... 252/390; 544/402; 546/229, 246; 564/323, 367, 368, 369, 370; 422/7, 12, 13, 16

[56] References Cited

U.S. PATENT DOCUMENTS

| | | | |
|---|---|---|---|
| 2,318,729 | 5/1943 | Wilson | 564/368 X |
| 2,886,604 | 5/1959 | Schmerling | 570/190 |
| 3,280,097 | 10/1966 | Cizek | 564/368 X |
| 3,303,219 | 2/1967 | Keith et al. | 564/368 |
| 3,539,633 | 11/1970 | Piasek et al. | 564/368 |
| 3,687,859 | 8/1972 | Silverstein | 252/180 |
| 4,202,780 | 5/1982 | Brandle | 525/330.4 X |
| 4,855,184 | 8/1989 | Klun et al. | 428/425.1 |

OTHER PUBLICATIONS

Corrosion Science, Band 23, Nr. 5, 1983, Pergamon Press, Oxford, New York, Frankfurt, T. Szauer et al., "The Corrosion Inhibition of Iron by Amines and Fatty Acids in Neutral Media" Seiten 473–480, *Zusammenfassung; Seite 473*.

Publication of Nace, Ban 37, Nr. 5 Mai 1981 M. Duprat et al. 34//Corrosion, The Journal of Science and Engineering, an Official "Inhibition of Corrosion of a Carbon Steel by the Aliphatic Fatty Polyamines in Association with Organic Phosphorous Compounds in 3% Sodium Chloride Solutions", Seiten 262–266, *Zusammenfassung; Seite 262*.

Soviet Inventions Illustrated, Sektion Ch, Woche E 18, 16, Jun. 1982, Derwent Publications Ltd., London M11, E11 *SU-842 111 (DNE-Prodzerzhinsk)*.

Chemical Abstracts, Band 82, Nr. 21, 26, Mai 1975, Columbus, Ohio, U.S.A., M. Protive et al., "Stimulant and Anti Depressant 1-(2-substituted Benzyl)piperazines" Seite 635, Zusammenfassung Nr. 140 185 g & CS-A-151 753 (Cl. C 07 d).

Chemical Abstracts, Band 82, Nr. 21, 26, Mai 1975, Columbus, Ohio, U.S.A., M. Protiva et al., "Neurotropic 1-(2-substituted benzyl)piperazines", Seite 635, Zusammenfassung Nr. 140 189m & CS-A-151 755 (Cl. C 07 d).

Chemical Abstracts, Band 93, Nr. 11, 15, Sep. 1980, Columbus, Ohio, U.S.A., D. Reinehr et al., "3-Phenoxybenzylamine and 3-benzylbenzylamine", Seite 692, Zusammenfassung Nr. 114 139c & EP-Al-0.

*Primary Examiner*—Richard L. Raymond

*Attorney, Agent, or Firm*—Sprung Horn Kramer & Woods

[57] ABSTRACT

It has been found out that polyaralkylamines of the formula stated in the claims are useful as corrosion inhibitors for metallic materials; furthermore were found out new polyaralkylamines of the formula stated in the claims and a process for their preparation.

2 Claims, No Drawings

USE OF POLYARALKYLAMINES AS CORROSION INHIBITORS

The invention relates to the use of polyaralkylamines as corrosion inhibitors for metallic materials and to new polyaralkylamines and to a process for their preparation.

It is known to employ long-chain polyamines, particularly those derived from comparatively long fatty acids, as corrosion inhibitors which form a protective film (compare, for example, T. Szauer, A. Brandt, Corrosion Science, Vol. 23, No. 5, 473–480 (1983); M. Duprat et al, Corrosion, Vol. 36, 262–266 (1981); and U.S. Pat. Nos. 3,718,604, 3,171,433 and 3,687,859). Those derived from cyclic or polycyclic higher carboxylic acids, for example naphthenic acids or resin acids, are particularly distinguished by their action. As natural products, however, the naphthenic acids or resin acids are not available without limitations. In addition, their quality varies greatly with their origin in a particular case.

On the other hand, amines having a short chain length or unsubstituted polyalkyleneamines as a rule do not exhibit an adequate corrosion-inhibiting action, or any action at all, with metallic materials.

The present invention relates to the use of polyaralkylamines of the formula

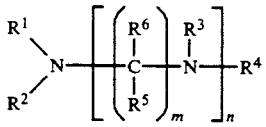

(I)

wherein $R^1$ to $R^4$ are identical or different and denote hydrogen, $C_1$–$C_{18}$-alkyl, $C_5$–$C_{12}$-cycloalkyl, $C_7$–$C_{18}$-aralkyl poly-$C_7$–$C_{18}$-aralkyl having 2 to 50 aralkylene units or $C_6$–$C_{15}$-aryl, or $R^1$ to $R^4$ are linked to one another in such a manner that in each case two of the radicals, together with the nitrogen atom linking them or together with the N-C-containing remainder of the chain, form a 5-membered to 6-membered ring, at least one of the radicals $R^1$ to $R^4$ denoting $C_7$–$C_{18}$-aralkyl poly-$C_7$–$C_{18}$-aralkyl, and $R^5$ and $R^6$ independently of one another denote hydrogen, $C_1$–$C_6$-alkyl, $C_5$–$C_7$-cycloalkyl, $C_7$-$C_{12}$-aralkyl or $C_6$–$C_{10}$-aryl, m represents an integer from 2 to 10, and n denotes 0 to 30, and, if n =0, at least one of the radicals $R^1$, $R^2$ and $R^4$ denotes polyaralkyl and it is possible for the C-chain defined by m to contain different radicals $R^5$ and $R^6$ and for the C-N chain defined by n to have different values of m, as corrosion inhibitors for metallic materials.

Suitable alkyl radicals of the formula (I) are those having 1 to 18 carbon atoms, preferably 1 to 12 carbon atoms and particularly preferably 1 to 6 carbon atoms. The following may be mentioned: methyl, ethyl, propyl, n-butyl, i$obutyl, hexyl, ethylhexyl, decyl and stearyl, preferably methyl, ethyl, n-butyl and ethylhexyl and particularly preferably methyl, ethyl and n-butyl.

Suitable cycloalkyl radicals are those having 5 to 12 carbon atoms, preferably 5 to 7 carbon atoms. The following may be mentioned: cyclohexyl and methylcyclohexyl.

Suitable aralkyl radicals are those having 7 to 18 carbon atoms, preferably those having 7 to 12 carbon atoms, and particularly preferably those having 7 to 9 carbon atoms. The following may be mentioned: benzyl, α-methylbenzyl, α,α-dimethylbenzyl, 4-methylbenzyl, tert.-butylbenzyl, methoxybenzyl and 3-chlorobenzyl, preferably benzyl.

Suitable polyaralkyl radicals are those having 7 to 18 Carbon atoms per aralkylen unit, preferably those having 7 to 12 carbon atoms and particularly preferably those having 7 to 9 carbon atoms. In general, the polyaralkyl radicals contain 2 to 50 aralkylene units, preferably 2 to 30 aralkylene units and particularly preferably 2 to 12 aralkylene units.

Suitable aryl radicals are those having 6 to 15 carbon atoms, preferably those having 6 to 12 carbon atoms and particularly preferably those having 6 to 8 carbon atoms. The following may be mentioned: phenyl, tolyl and chlorophenyl, preferably phenyl.

The piperidinyl radical

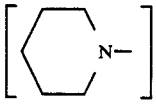

may be mentioned as radicals $R^1$ to $R^4$ which can be attached to one another by a nitrogen atom linking them.

The piperazinylene radical

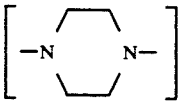

may be mentioned as radicals $R^1$ to $R^4$ which can be attached to one another by the N-C-containing remainder of the chain.

The use of polyaralkylamines of the formula (I) in which m represents an integer from 2 to 6, particularly preferably 2 and 3, and n denotes 1 to 20, particularly preferably 2 to 10, is preferred.

The following are mentioned in terms of formulae as examples of corrosion-inhibiting polyaralkylamines:

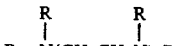

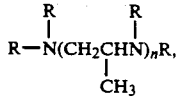

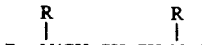

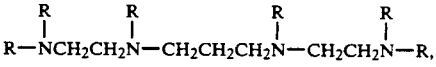

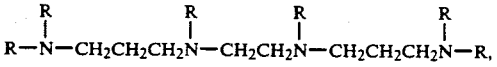

-continued

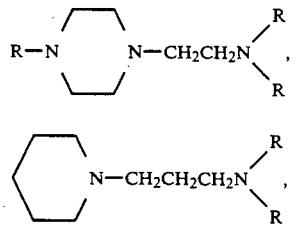

in which H

R represents hydrogen,

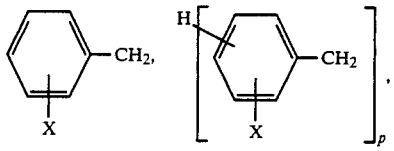

methyl, ethyl, n-butyl, iso-butyl, stearyl, cyclohexyl, phenethyl, phenyl, chlorophenyl or tolyl, X denotes hydrogen, methyl, chlorine or methoxy, p represents 2 to 50, and n represents 1 to 8.

The following polyaralkylamines may be mentioned individually as examples: di-, tri-, tetra- and pentabenzyldiethytenetriamine, -triethylenetetramine, -tetraethylenepentamine, -pentaethylenehexamine, -heptaethyleneoctamine, -N,N'-bis-aminoethyl-propylenediamine and -N'N'-bisaminopropylethylenediamine, perbenzyl-triethylenetetramine, -tetraethylenepentamine, -pentaethylenehexamine, -hexaethyleneheplamine, -aminoethylpiperazine and aminopropyl-piperidine, tetrabenzylstearyl-diethylenetri amine and -pentaethylenehexamine, tribenzyl-cyclohexyltriethylenetetramine and -tetraethylenepentamine, tetra(p-methylbenzyl)-pentaethylenehexamine, mono-, bis- and tris-(polybenzyl)-diethylenetriamine, -triethylenetetramine, -tetraethylenepentamine, -pentaethylenehexamine, -heptaethyleneoctamine, -1,2- and 1,3-dipropylenetriamine, -tripropylenetetramine, -stearyl-hexamethylenediamine -N,N'-bis-aminoethylpropylenediamine, -N,N'-bis-amino-propyl-ethylenediamine, -aminoethylpiperazine and -aminopropylpiperidine, (polybenzyl)-tetrabenzyl-diethylenetriamine, -triethylenetetramine, -tetraethylenepentamine and -N,N'-bis-aminoethyl-propylenediamine, (polybenzyl)hexabenzyl-tetraethylenepentamine, -pentaethylenehexamine and -hexaethyleneheptamine, (polybenzyl)-tetrabenzyl-1,2and 1,3-dipro-pylenetriamine, bis-(polybenzyl)-tribenzyldiethylenetriamine, -dipropylenetriamine, -tetraethylenepentamine and -N,N'-bis-aminopropyl-ethylenediamine, bis(polybenzyl)-pentabenzyl-tetraethylenepentamine, -heptaethyleneoctamine, tris-(polybenzyl)-tribenzyltriethylenetetramine, -tetraethylenepentamine and -pentaethylenehexamine, bis-(polybenzyl)-dibenzyl-phenyldipropylenetriamine and (poly-methylbenzyl)-dimethylbenzyl-diethylenetriamine.

The corrosion-inhibiting polyaralkylamines can be employed as a protection against corrosion for metallic materials either on their own or in any desired mixtures with one another or mixed with other inhibitors. The following may be mentioned as additional, known corrosion inhibitors: fatty amines, quaternary ammonium salts, N-heterocyclic compounds, such as imidazolines, imazoles, thiazoles and triazoles, and alkynols such as propargyl alcohol, and phosphonic acids.

The polyaralkylamines of the formula (I) and the corrosion inhibitors mentioned can be employed in any desired mixing ratio with one another. Preferred mixing ratios can be determined easily by suitable preliminary tests.

The polyaralkylamines, according to the invention, of formula (I) can be added, in order to protect metallic materials against corrosion, to any media which have a corrosive action on these materials. The following may be mentioned as examples of media having a corrosive action: heat transfer media (cooling and heating fluids), hydraulic fluids, petroleum (fractions), propellants and fuels, metal-working fluids or emulsions, acids for purifying, pickling and acidizing bore holes in the extraction of petroleum, metal coating agents and plastics, for example as insulating agents or in processing at fairly high temperatures, for example in extrusion.

The following are mentioned as examples of metallic materials which can be protected against corrosion: ferrous metals (cast iron or steel), copper, brass, zinc, lead and aluminium, preferably ferrous metals and copper and very particularly preferably ferrous metals.

The amount of polyaralkylamines of the formula (I) to be used can be varied within wide ranges and depends particularly on the nature of the medium having a corrosive action. As a rule, the polyaralkylamines are employed in an amount of about 0.001 to 3% by weight, preferably 0.05 to 1% by weight, relative to the medium having a corrosive action.

The polyaralkylamines of the formula (I) are preferably employed in combination with customary formulating agents, such as solvents and dispersing agents. The following may be mentioned as solvents and dispersing agents: aliphatic or araliphatic alcohols, such as isooctanol and benzyl alcohol, amides, such as dimethylformamide and oxethylated derivatives of alcohols or amines, such as 2-ethylhexanol, lauryl alcohol, cetyl alcohol, dodecylamine, tallow fatty amine and nonylphenol.

The amount of solvent and/or dispersing agent which is advantageous in a particular case can be determined easily by means of preliminary tests.

The present invention also relates to new polyaralkylamines of the formula

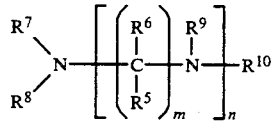

(II)

wherein $R^7$ to $R^{10}$ are identical or different and denote hydrogen, $C_1$–$C_{18}$-alkyl, $C_5$–$C_{12}$-cycloalkyl, $C_7$–$C_{18}$-aralkyl, poly-$C_7$–$C_{18}$-aralkyl having 2 to 50 aralkylene uni $C_6$–$C_{15}$-aryl, or $R^7$ to $R^{10}$ are linked to one another in such a way that in each case two of the radicals, together with the nitrogen atom linking them or with the N-C-containing remainder of the chain, form a 5-membered to 7-membered ring, at least one of the radicals $R^7$ to denoting poly-$C_7$–$C_{18}$aralkyl having 2 to 50 aralkylene units, $R^5$ and $R^6$ independently of one another denote hydrogen, $C_1$–$C_6$-alkyl, $C_5$–$C_7$-cycloalkyl, $C_7$–$C_{12}$-aralkyl or $C_6$–$C_{10}$-aryl, m represents an integer from 2 to 10, and n denotes 0 to 30, it being possible for the C chain defined by m to contain different radicals $R^5$ and $R^6$ and for the C-N chain defined by n to have differing values for m.

The following may be mentioned in terms of formulae as examples of new polybenzylamines:

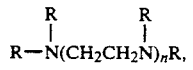

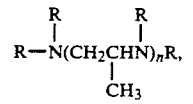

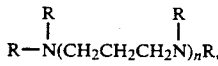

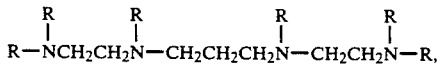

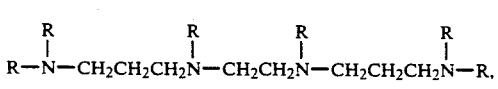

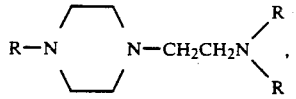

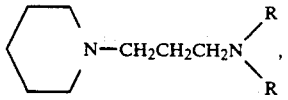

in which

R represents hydrogen,

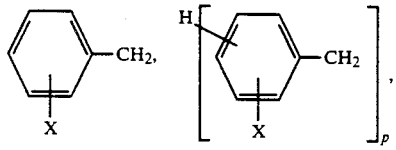

methyl, ethyl, n-butyl, iso-butyl, stearyl, cyclohexyl, phenethyl, phenyl, chlorophenyl or tolyl, X denotes hydrogen, methyl, chlorine or methoxy, p represents 2 to 50, and n represents 1 to 8, and at least one of the radicals R denotes

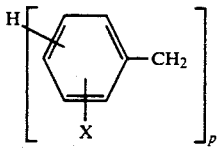

The following polyaralkylamines may be mentioned individually: mono-, bis- and tris-(polybenzyl)-diethylenetriamine, -triethylenetetramine, -tetraethylenepentamine, -pentaethylenehexamine, -heptaethyleneoctamine, -1,2- and 1,3-dipropylenetriamine, -tripropylenetetramine, -stearylhexamethylenediamine, -N,N'-bis-aminoethyl-propylenediamine, -N,N'-bis-aminopropyl-ethylenediamine, -aminoethylpiperazine and -aminopropylpiperidine, (polybenzyl)-tetrabenzyl-diethylenetriamine, -triethylenetetramine, -tetraethylenepentamine, and -N,N'-bis-aminoethyl-propylenediamine, (polybenzyl)-hexabenzyl-tetraethylene-pentamine, -pentaethylenehexamine and -hexaethyleneheptamine, (polybenzyl)-tetrabenzyl-1,2- and 1,3-dipropylenetriamine, bis-(polybenzyl)- tribenzyl-diethylenetriamine, -dipropylenetriamine, -tetraethylenepentamine and -N,N'-bis-aminopropyl-ethylenediamine, bis-(polybenzyl)-pentabenzyl-tetraethylenepentamine, -heptaethyleneoctamine, tris-(polybenzyl)-tribenzyl-triethylenetetramine, -tetraethylenepentamine and -pentaethylenehexamine, bis-(polybenzyl)-dibenzyl-phenyldipropylenetriamine and (polymethylbenzyl)-di-methylbenzyl-diethylenetriamine.

The invention also relates to a process for the preparation of new polyaralkylamines of the formula (II)

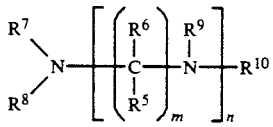

(II)

wherein $R^7$ to $R^{10}$ are identical or different and denote hydrogen, $C_1$–C18-alkyl, $C_5$–$C_{12}$-cycloalkyl, $C_7$–$C_{18}$aralkyl, poly-$C_7$–$C_{18}$-aralkyl having 2 to 50 aralkylene units or $C_6$–$C_{15}$-aryl, or $R^7$ to $R^{10}$ are linked to one another in such a way that in each case two of the radicals, together with the nitrogen atom linking them or with the N-C-containing remainder of the chain, form a 5-membered to 7-membered ring, at least one of the radicals $R^7$ to $R^{10}$ denoting poly-$C_7$–$C_{18}$aralkyl having 2 to 50 aralkylene units, $R^5$ and $R^6$ independently of one another denote hydrogen, $C_1$–$C_6$-alkyl, $C_5$–$C_7$-cycloalkyl, $C_7$–$C_{12}$-aralkyl $C_6$–$C_{10}$-aryl, m represents an integer from 2 to 10 and n denotes 0 to 30, it being possible for the C chain defined by m to contain different radicals $R^5$ and $R^6$ and for the C-N chain defined by n to have differing values for m, which is characterized in that amines of the formula

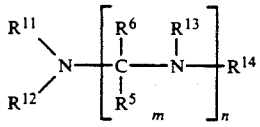

(III)

wherein $R^{11}$ to $R^{14}$ are identical or different and denote hydrogen, $C_1$–$C_{18}$-alkyl, $C_5$–$C_{12}$-cycloalkyl, $C_7$–$C_{18}$-aralkyl or $C_6$–$C_{15}$-aryl, or $R^{11}$ to $R^{14}$ are attached one another in such a way that in each case two of the radicals, together with the nitrogen atom linking them or together with the N-C-containing remainder of the chain, form a 5-membered to 7-membered ring, at least one of the radicals $R^{11}$ to $R^{14}$ denoting hydrogen, and $R^5$, $R^6$, m and n have the meaning mentioned above, are reacted with poly-$C_7$–$C_{18}$-aralkyl halides of the formula (IV)

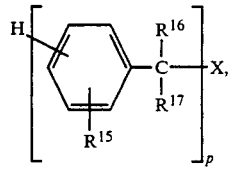

(IV)

wherein $R^{15}$ represents hydrogen, halogen, $C_1$–$C_4$-alkoxy or $C_1$–$C_6$-alkyl, $R^{16}$ and $R^{17}$ are identical or different and denote hydrogen or $C_1$–$C_6$-alkyl, p represents an integer from 2 to 50, and X represents halogen, if appropriate together with mono-$C_7$–$C_{18}$-aralkyl halides of the formula (V)

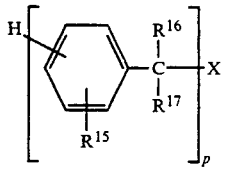

(V)

wherein $R^{15}$ to $R^{17}$ and X have the abovementioned meaning and p denotes 1.

Besides ammonia, the following are examples of suitable primary and secondary amines of the formula (III):

Methyl-, ethyl-, butyl-, isooctyl-, dodecyl-, stearyl-, allyl-, cyclo-hexyl- and benzylamine, dimethyl-, dibutyl-, methyl-cyclohexyl-, methyl-benzyl- and ethyl-dodecyl-, aniline, N-methyl-, N-ethyl- and N-butyl-, ethylenediamine, methyl-, dimethyl-, isooctylethyl-, stearyl-, cyclohexyl-, allyl-, benzyl-, phenyl-ethylenediamine, 1,2-and 1,3-propylenediamine, methyl-propyldodecyl-, palmityl-, cyclohexyl-, phenyl-1,2- and 1,3-propylenediamine, butylenediamine, N-stearyl-butylenediamine, 2,5-diamino-2,5-dimethylhexane, hexa-methylenediamine, N-cyclohexylhexamethylenediamine, tri-methyl-1,6-hexamethylenediamine, octamethylenediamine, diethylenetriamine, dipropylenetriamine, N-aminoethylpropylenediamine, dihexylenetriamine, triethylenetetramine, tripropylenetetramine, N,N'-bis(aminopropyl)-ethylenediamine, N,N'-bis-(aminoethyl)propylenediamine, N,N'-bis-(aminopropyl)-butylenediamine, tetraethylenepentamine, pentaethylenehexamine, hexaethyleneheptamine, heptaethyleneoctamine, mixtures of higher polyethylene polyamines (distillation residue from the preparation of ethylene-polyamines), N-methyl-, N-stearyl-, N-cyclohexyl-, N-phenyl-, N,N'-dilauryl-dipropylene-triamine, N,N'-dipalmitinpentaethylenehexamine, diaminocyclohexane, isophoronediamine, piperidine, N-aminoethyl. N-aminopropyl-, N-amino-ethylamino-ethyl-piperidine, piperazine, N-methyl-, N-phenyl-, N-benzyl-, N-aminoethyl-, N-aminopropyl-, N,N'-bis-aminoethyl- and N,N,'-bis-aminopropylpiperazine, preferably ammonia, methylamine, allylamine, aniline, ethylenediamine, propylenediamine, N-methyl-propylenediamine, N-phenylpropylenediamine, butylenediamine, hexamethylene-diamine, diethylenetriamine, dipropylenetriamine, N-amino-ethyl-propylenediamine, triethylenetetramine, tri-propylenetetramine, N,N'-bis-(aminopropyl)-ethylenediamine, N,N'-bis-(aminoethyl)-propylenediamine, tetraethylenepentamine, pentaethylenehexamine, hexaethyleneheptamine, isophoronediamine, piperidine, piperazine and N-aminoethylpiperazine.

Poly-$C_7$–$C_{18}$-aralkyl halides having 2 to 50 aralkylene units of the formula IV ($p > 1$) which may be mentioned are those which are derived from benzyl chloride, benzyl bromide, the o-, m- and p-isomers of methyl-, ethyl-, butyl-, chloro- and methoxy-benzyl chloride and also from o-methyl- and o,o-dimethyl-benzyl chloride, preferably benzyl chloride.

In general, the amines of the formula (III) are reacted with the aralkyl halides of the formula (IV) in the stoichiometric ratio. It can, however, also be advantageous to use an excess of amines of the formula (III) (2 to 10 moles of amine per mole of aralkyl halide) and to remove excess amine after the reaction is complete. This is preferably effected by vacuum distillation.

The reaction of the amines with the aralkyl halides can be carried out without the concomitant use of special hydrogen halide acceptors. In this case the hydrohalides of the process products according to formula (II) are obtained. In general, however, condensation is carried out in the presence of customary hydrogen halide acceptors, for example in the presence of tertiary amines, preferably in the presence of alkali metal hydroxides and/or carbonates.

The reaction of the amines can be carried out in bulk without the presence of special solvents. It is also possible, however, to use solvents or mixtures thereof concomitantly. Examples of suitable solvents are water, hydrocarbons, such as petroleum ether, cyclohexane, ligroin, benzene, toluene or xylene, chlorinated hydrocarbons, such as methylene chloride, chloroform, tri- and tetrachloroethane, chlorobenzene or dichlorobenzene, esters, such as ethyl acetate or butyl acetate, and alcohols, such as methanol, ethanol, iso-propanol and methylglycol.

The reaction temperatures can vary within wide limits. In general they are −20° to 200° C., preferably 20° to 120° C.

The isolation of the new polyaralkylamines of the formula (II) depends on whether the hydrogen halides or the free bases of the amines of the formula (II) are desired If the hydrogen halides are desired, excess amine which may be present is removed by vacuum distillation. The residues left are generally resinous; in many cases they can be processed to give aqueous and/or alcoholic solutions, that is to say colloidal solutions.

If the free amine bases are desired, these are, as a rule, obtained in solution in an organic solvent, if alkali metal hydroxides are used as hydrogen halide acceptors. They can be processed further as such or can be isolated by removing the solvent by distillation.

Finally, the present invention relates to a process for the preparation of pol $C_7$–$C_{18}$-aralkyl halides of the formula (IV)

(IV)

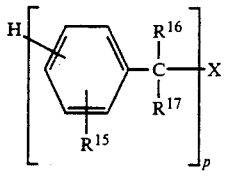

wherein $R^{15}$ represents hydrogen, halogen, $C_1$–$C_4$-alkoxy or $C_1$–$C_6$-alkyl, $R^{16}$ and $R^{17}$ are identical or different and denote hydro gen or $C_1$- to $C_6$-alkyl, p represents an integer from 2 to 50, and X represents halogen, which is characterized in that mono-$C_7$- to $C_{18}$-aralkyl halides of the formula (V)

(V)

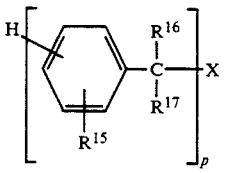

wherein $R^{15}$ to $R^{17}$ and X have the abovementioned meaning and p is 1, are subjected to a condensation reaction in the presence of condensation agents until 5 to 70 mol % of the amount of hydrogen halide to be split off has been converted, and, if appropriate, the unreacted amount of starting material is removed.

The following are examples of condensation agents which can be employed iron, zinc, iron-III chloride, iron-II and iron-III oxide, zinc chloride, zinc acetate, zinc stearate, aluminium chloride, aluminium oxide, silicon dioxide, clays, such as montmorillonite, and/or zeolites. It is preferable to employ zinc chloride and/ or zinc stearate The condensation agents are usually employed in catalytic amounts, for example in amounts of 0.01 to 1, preferably 0.1 to 0.5, % by weight, relative to the $C_7$–$C_{18}$-monoaralkyl halide (V) employed.

It is preferable to subject the aralkyl halides to a condensation reaction until 10 to 50 mol %, particularly preferably 15 to 40 mol %, of the amount of hydrogen halide to be split off has been converted.

The conversion in the condensation reaction according to the invention is controlled, for example, by determining the amount of hydrogen halide split off. This can be carried out, for example, by means of a rotameter or by titration. Inhibitors or deactivators of the condensation reaction are usually added in order to control the condensation reaction by terminating the elimination of hydrogen halide. The following may be mentioned as examples of inhibitors or deactivators: quaternary ammonium salts, amines and/or amides, such as caprolactam, and/or phosphines, such as triphenylphosphine.

As a rule, the condensation reaction according to the invention is carried out in bulk; it can, however, also be effected with the concomitant action of suitable solvents, for example chlorinated hydrocarbons, such as methylene chloride and/or chloroform. It can be carried out either continuously or discontinuously.

The reaction temperature can be varied within wide limits, depending on the nature and/or amount of the condensation agent and in regard to the desired degree of condensation. In general, it is about −50° to 200° C., preferably 0° to 180° C. and particularly preferably 50° to 150° C.

The removal of the unreacted monoaralkyl halide of the formula (V) from the condensation mixture can be effected, for example, by vacuum distillation.

PREPARATION EXAMPLES

Example 1

126.6 g (1 mole) of benzyl chloride and 0.2 g of Zn stearate are heated to 80°–110° C., in the course of which vigorous evolution of HCl sets in. When 0.25 mole of HCl have been split off (titration against sodium hydroxide solution), the reaction is stopped by adding 0.2 g of triphenylphosphine. Excess benzyl chloride (80 g/0.63 mole) is distilled off in vacuo, the resin is taken up in 100 ml of toluene, and the solution is yl added dropwise at 25°–35° C. to 103 g (1 mole) of diethylenetriamine. The solvent is then distilled off under normal pressure until the bottom temperature is 200° C. and excess diethylenetriamine is then distilled off in 35 vacuo. 44 g (~100% of theory) of a yellow-orange, water-soluble resin is obtained in this way. $C_{39}H_{44}ClN_3$ (590.3): Calculated: C, 79.36%; H 7.51%; Cl, 6.00%, N, 7.12% Found: C, 79.09%, H, 7.60%; Cl, 6.18%; 7.29.

In order to obtain the free base, the hydrochloride is dissolved in approx. 300 ml of toluene and extracted by shaking with dilute sodium hydroxide solution (~0.2 mole). Drying the toluene phase and concentrating it in vacuo gives 37 g of a slightly cloudy, brownish, viscous oil.

Example 2

Using 232 g (1 mole) of pentaethylenehexamine instead of diethylenetriamine, 53.5 g (~100%) of a yellow-orange, water-soluble resin are obtained (as the hydrochloride) by the procedure of Example 1.

$C_{45}H_{59}ClN_6$ (719.5). Calculated: C,75.12%; H, 8.27%., Cl ,4.93%., N, 11.69%. Found: C,74.89%, H, 8.33%, Cl 4.69; N,11.80.

Example 3

After 5.25 g of Zn stearate have been added, 4,431 g (35 moles) of benzyl chloride are heated with stirring to 80–100° C., in the course of which vigorous evolution of HCl sets in. When 7 moles (20%) of HCl have been eliminated (titration with sodium hydroxide solution in a receiver), the reaction is stopped by adding 7 g of caprolactam, and excess benzyl chloride is distilled off in vacuo until a bottom temperature of approx. 100° C. has been reached. This gives 3,080 g (24.3 moles) of benzyl chloride and 1,076 g of a brownish oil with yellowish fluorescence, containing 9.05% of reactive Cl.

Example 4

2,668 g (21 moles) of benzyl chloride as well as 1,370 g of a brownish oil containing 7.25% of reactive Cl are obtained analogously to Example 3 if 10.5 moles (30%) of HCl are eliminated.

Example 5

2,288 g (18 moles) of benzyl chloride and 1,630 g of a viscous oil with a yellowish-green fluorescence, containing 5.6% of reactive Cl, are obtained analogously to Example 3 if 14 moles (40%) of HCl are eliminated.

Example 6

50 g (0.1 mole) of the polybenzyl chloride according to Example 4 are added dropwise in the course of 30 minutes, at 50°-80° C. and with stirring, to 23.2 g (0.1 mole) of pentaethylenehexamine. After ~2 hours at 80° C. to complete the reaction, a water-soluble, pale yellow-brownish resin is obtained (yield 100%).

$C_{45}H_{59}ClN_6$ (719.5): Calculated; C,75.12%; H,8.27; Cl,4.93., N,11.69. Found. C,75.51%; H,8.20; Cl, 4,69; N,11.48.

Example 7

50 g of the polybenzyl chloride according to Example 4 are reacted in the same way as in Example 6 with 18.9 g (0.1 mole) of tetraethylenepentamine: 68.9 g (~100%) of a pale yellow-brownish resin which is soluble in water, giving a slightly cloudy, opaque consistency. $C_{43}H_{54}ClN_5$ (676.4). Found: C,76.59%; H,7.95%; Cl, 5.12%; N,10.18

Example 8

126.6 g (1 mole) of benzyl chloride and 0.2 g of Zn stearate are heated at 80°-110° C. The vigorous evolution of HCl is stopped by adding 0.2 g of caprolactam when 50% (0.5 mole) elimination has been reached. Excess benzyl chloride is distilled off in vacuo (approx. 46 g), the residual resin is taken up in 150 ml of toluene, and the solution is run into 116 g (0.5 mole) of pentaethylenehexamine at ~25-30° C., with stirring. By heating to the boil, solvent is removed under normal pressure, and excess amine is removed under an oil pump vacuum until the bottom temperature reaches 250° C. 80.9 g (99% of theory) of a brownish, viscous, water-soluble resin are obtained.

$C_{66}H_{77}ClN_6$ (989.85) Calculated: C,80.08%; H,7.84%; Cl, 3.58%; N,8.49%. Found: C,80.25%; H,7.70%; Cl,3.39%; N,8.28%.

Conversion into the free base analogously to Example 1 gives 72.2 g of an oil with a yellow-green fluorescence.

The degrees of condensation of benzyl chloride are varied in the following examples using the same procedure as in Example 8:

| Example | % Elimination of HCl | Benzyl resin polyamine.HCl | | Free base |
|---|---|---|---|---|
| 9 | 66 | 46.9 g (98%) | | 45.0 g |
| | | $C_{73}H_{83}ClN_6$ (1,080.0) | | |
| Calculated | C 81.19% | H 7.75% | Cl 3.28% | N 7.78% |
| Found | 80.87 | 7.77 | 2.95 | 7.93 |
| 10 | 75 | 97.3 g (99.7%) | | |
| | | $C_{80}H_{89}ClN_6$ (1,170.1) | | |
| Calculated | C 82.12% | H 7.67% | Cl 3.03% | N 7.18% |
| Found | 82.37 | 7.51 | 2.94 | 7.23 |

Example 11

253.2 g (2 moles) of benzyl chloride, together with 0.4 g of Zn stearate, are kept at 105°-115° C. until 0.5 mole (25%) of HCl have been split off. The reaction is stopped by adding 0.4 g of triphenylphosphine, excess benzyl chloride is distilled off in vacuo until the bottom temperature reaches approx. 110° C., the resinous residue is taken up in 150 ml of toluene and the solution is run into 146.2 g (1 mole) of triethylenetetramine at 20°-30° C., with stirring. After the mixture has been heated to reflux temperature, the solvent is distilled off under normal pressure until the bottom temperature reaches approx. 200° C., and the excess triethylenetetramine is then distilled off under a high vacuum until the same temperature is reached. This gives 98.8 g (96.4% of theory) of a tacky, water-soluble resin which, after being extracted by shaking with 500 ml of toluene and 150 ml 1N sodium hydroxide solution, affords 77.8 g of the corresponding free amine base in the form of an orange-brownish resin.

Hydrochloride: $C_{34}H_{43}ClN_4$ (543.2). Calculated: C, 75.18%; H, 7.98%; Cl,6.53%; N,10.12.

In the following examples, the procedure is analagous to Example 11 and the condensation of the benzyl chloride is varied:

| Example | % Elimination of HCl | Benzyl resin polyamine.HCl | | Free base |
|---|---|---|---|---|
| 12 | 33 | 104.1 g (89.2%) | | 86.4 g |
| | | $C_{48}H_{55}ClN_4$ (723.5) | | |
| Calculated | C 79.69% | H 7.66% | Cl 4.90% | N 7.75% |
| Found | 79.82 | 7.51 | 4.69 | 7.53 |
| 13 | 50 | 140.9 g (99%) | | 117.4 g |
| | | $C_{62}H_{67}ClN_4$ (903.7) | | |
| Calculated | C 82.40% | H 7.47% | Cl 3.92% | N 6.20% |
| Found | 82.61 | 7.31 | 3.70 | 6.39 |
| 14 | 75 | 182.4 g (99.5%) | | 150 g |
| | | $C_{76}G_{79}ClN_4$ (1,083.9) | | |
| Calculated | C 84.21% | H 7.35% | Cl 3.27% | N 5.17% |
| Found | 84.40 | 7.23 | 3.12 | 5.31 |

Example 15

If 378.6 g (2 moles) of tetraethylenepentamine are used instead of triethylenetetramine in accordance with Example 11, 110.8 g (99.5% of theory) of a tacky, brownish, water-soluble resin (hydrochloride) are obtained, or 95.5 g of the corresponding amine base. Hydrochloride $C_{36}H_{48}ClN_5$ (586.3).: Calculated: C,73.75%; H,8.25%; Cl,6.05; N,11.95%. Found: C, 73.93%, H, 8.11%, Cl, 5.89%, N,11.78.

In the following examples, the degrees of benzyl chloride condensation are varied, using a procedure analogous to that of Example 15.

| Example | % Elimination of HCl | Benzyl resin polyamine.HCl | | Free base |
|---|---|---|---|---|
| 16 | 50 | 150.1 g (~100%) | | 128 g |
| | | $C_{64}H_{72}ClN_5$ (946.8) | | |
| Calculated | C 81.19% | H 7.67% | Cl 3.75% | N 7.40% |
| Found | 81.32 | 7.51 | 3.65 | 7.51 |
| 17 | 75 | 185.7 g (94.6%) | | 165.1 g |
| | | $C_{78}H_{84}ClN_5$ (1,127.03) | | |
| Calculated | C 83.13% | H 7.51% | Cl 3.15% | N 6.22% |
| Found | 83.21 | 7.43 | 3.07 | 6.34 |

Example 18

If, with the same procedure as in Example 11, 102 g (1 mole) of N,N-dimethyl-1,3-propylenediamine are used instead of triethylenetetramine, 80.5 g (91.1% of theory) of a greenish, tacky resin (free base) are obtained.

$C_{33}H_{38}N_2$ (4.62.7): Calculated: C,85.67%; H, 8.28%; N,6.06%. Found: C,85.79%; H, 8.13%; N,6.01.

In the following examples, the procedure is analogous to Example 18 and the degree of concentration of the benzyl resin is varied:

| Example | % Elimination of HCl | Benzyl resin polyamine (free base) | |
|---|---|---|---|
| 19 | 33 | 97.6 g (97.2% of theory) | |
| | $C_{47}H_{50}N_2$ (642.9) | | |
| Calculated | C 87.80% | H 7.84% | N 4.36% |
| Found | 87.97 | 7.71 | 4.21 |
| 20 | 50 | 111 g (96.4% of theory) | |
| | $C_{61}H_{62}N_2$ (823.2) | | |
| Calculated | C 89.00 | H 7.59% | N 3.40 |
| Found | 89.12 | 7.45 | 3.32 |

Example 21

2 moles of benzyl chloride are subjected to condensation analogously to Example 11 to give a 25% elimination of HCl, and excess benzyl chloride is removed in vacuo. 206 g (2 moles) of diethylenetriamine are then stirred, all at once, at room temperature, into the residue, which has the viscosity of a resin. The exothermic reaction which gradually sets in is completed by heating to 110° C. After 2 hours at this temperature, excess amine is distilled off in vacuo until the bottom temperature reaches about 100° C. to give 105 g (99.2% of theory) of a honey-coloured, viscous resin (hydrochloride) which is soluble in water to give a soapy consistency.

$C_{32}H_{38}ClN_3$ (500.1): Calculated. C,76.85%, H, 7.66%; Cl, 7.09%; N,8.40%. Found: C,76.97%; H,7.49%; Cl, 7.01%; N,8.31.

Example 22

If 292.4 g (2 moles) of triethylenetetramine are used, analogously to Example 21, instead of diethylenetriamine, 113 g (98.3% of theory) of a honey-coloured, viscous resin (hydrochloride) are obtained, which can be compounded to form a 50% strength aqueous solution. $C_{34}H_{43}ClN_4$ (543.2): Calculated: C,75.18%; H, 7.98%; Cl, 6.3%; N,10.31%. Found: C, 75.29%; H,7.87%; Cl,6.38%; N,10.20.

In the following examples the degree of condensation of the benzyl resin is varied, using the procedure according to Example 22:

| Example | % Elimination of HCl | Benzyl resin polyamine HCl | | |
|---|---|---|---|---|
| 23 | 30 | 112 g (98.2%) | | |
| | $C_{41}H_{49}ClN_4$ (633.3) | | | |
| Calculated | C 77.76% | H 7.80% | Cl 5.60% | N 8.85% |
| Found | 77.89 | 7.69 | 5.48 | 8.77 |
| 24 | 40 | 122 g (98.4%) | | |
| | $C_{55}H_{61}ClN_4$ (813.6) | | | |
| Calculated | C 81.20 | H 7.56 | Cl 4.36 | N 6.89 |
| Found | 81.33 | 7.49 | 4.23 | 6.75 |
| 25 | 50 | 140 g (93.3%) | | |
| | $C_{62}H_{67}ClN_4$ (903.7) | | | |
| Calculated | C 82.40 | H 7.47 | Cl 3.92 | N 6.20 |
| Found | 82.52 | 7.35 | 3.80 | 6.11 |
| 26 | 60 | 149 g (94.2%) | | |
| | $C_{69}H_{73}ClN$ (993.8) | | | |
| Calculated | C 83.39 | H 7.40 | Cl 3.57 | N 5.64 |
| Found | 83.48 | 7.31 | 3.43 | 5.51 |

Example 27

189.3 g (1 mole) of tetraethylenepentamine are stirred at room temperature into 47.5 g (0.075 mole) of the polybenzyl chloride resin according to Example 5, and the temperature is raised to 110° C. and is kept at this level for 2 hours. Removing the excess amine in vacuo gives 65 g (~100% of theory) of a brownish, tacky resin (HCl form) which can be processed to give an aqueous solution.

$C_{57}H_{66}ClN_5$ (856.65): Calculated: C,79.92%, H,7.77%, Cl, 4.14; N,8.18%. Found: C, 80.04% H,7.61%; Cl, 4.01%; N,8.10%.

Example 28

If 232.4 g (1 mole) of pentaethylenehexamine are employed, using the procedure of Example 27, 67 g (99.3% of theory) of a yellow-brown, viscous resin are obtained. $C_{59}H_{71}ClN_6$ (899.7): Calculated: C,78.76%; H,7.95%; Cl,3.94%; N,9.34%. Found: C,78.789%; H,7.83%; Cl, 3.83%; N,9.27.

Example 29

126.6 g (1 mole) of benzyl chloride, 26.3 g (0.15 mole) of o-xylylene chloride and 0.15 g of Zn stearate are subjected to a co-condensation reaction analogously to Example 11, with 25% elimination of HCl and, after excess monomers have been removed in vacuo, the resinous residue (59.0 g, 15% saponif. Cl) is reacled with 73.1g (0.5 mole) of triethylenetetramine. This gives 93.5 g (~100% of theory) of a tacky, viscous resin which can be compounded to give a 50% strength aqueous solution (idealized formula):

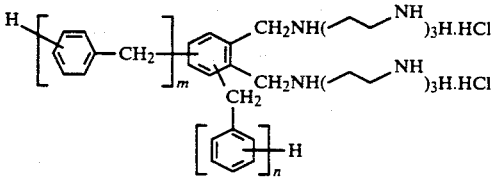

~$C_{41}H_{63}Cl_2N_8$ (737.9); Calculated: C,66.74%; H,8.47%; Cl, 9.61%; N, 15.19%. Found: C,66.86%; H,8.35%; Cl, 9.50%; N,15.06.

Example 20

126.6 g (1 mole) of benzyl chloride and 0.1 g of Zn stearate are subjected to a condensation reaction analogously to Example 8, with 50% elimination of HCl, the reaction is discontinued by adding 2–3 drops of triethylenetetramine, and then—without removing the excess benzyl chloride—14.6 g (0.1 mole) of triethylenetetramine are added dropwise at 100° C. in the course of 30 minutes. Stirring is continued for 30 minutes at this temperature, 100 ml of toluene and a solution of 20 g (0.5 mole) of NaOH in 50 ml of water are added and the mixture is kept under reflux for a further 3 hours. AFter cooling, the organic phase is separated off, washed with water and concentrated in vacuo until the bottom temperature reaches approx. 150° C.: 99.8 g (95.3% of theory) of a brownish, viscous, water-insoluble resin.

$C_{76}H_{78}N_4$ (1,047.5): Calculated: C,87.15%, H,7.51%; N,5.35%. Found: C,87.29%; H,7.43%; N,5.19.

In the following examples the procedure is similar, with variation of the degree of polybenzyl condensation:

| Example | % Elimination of HCl | Resin (free base) | |
|---|---|---|---|
| 31 | 30 | 101.1 g (96.5% of theory) | |
| Found | C 87.20 | H 7.39 | N 5.21 |
| 32 | 40 | 100.5 g (95.9% of theory) | |
| Found | C 87.31 | H 7.63 | N 5.15 |

Example 33

126.6 g (1 mole) of benzyl chloride, 0.15 g of Zn stearate (30% elimination of HCl), 18.9 g (0.1 mole) of tetraehtylenepentamine and 28 g (0.7 mole) of sodium hydroxide are reacted together analogously to Example 30. 107.8 g (98.8% of theory) of brownish, viscous resin are obtained.

$C_{78}H_{83}N_5$ (1,090.6): Calculated: C,85.91%; H,7.67%; N,6.42%. Found: C,86.09%; H,7.53%; N,6.30%.

Example 34

If 12 g (0.2 mole) of ethylene diamine are employed instead of tetraethylene pentamine, using the same procedure as in Example 33, 98.5 g (96.4% of theory) of a brownish, viscous oil are obtained.

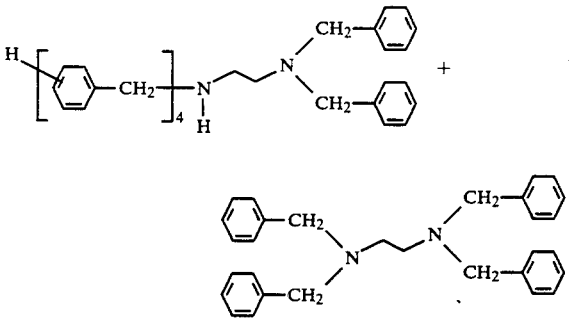

"$C_{74}/H_{76}N_4$ (1,021.5)": Calculated. C,87.02%; H,7.50%, N,5.49%. Found: C,87.23%, H,7.32%; N,5.61.

Example 35

253.2 g (2 moles) of benzyl chloride and 0.3 g of Zn stearate are subjected to a condensation reaction analogously to Example 11, with 30% elimination of HCl, the reaction is stopped by means of 2–3 drops of diethylenetriamine, and the benzyl chloride mixture is then added dropwise, at 60°–95° C., with stirring and in the course of 1 hour, to a mixture of 62 g (0.6 mole) of diethylenetriamine, 64 g (1.6 mole) of sodium hydroxide, 150 ml of $H_{20}$ and 100 ml of toluene. The mixture is kept at reflux temperature for a further 3 hours and the organic phase is separated off and concentrated in vacuo until the bottom temperature reaches 150° C.: 235 g (97% of theory) of an orange-brownish, viscous oil. "$C_{82}H_{99}N9$ (1,210.8)",: Calculated. C, 81.35%., H,8.24%. N,10.41%. Found: C,81.57%; H,8.19%; N,10.634%.

Example 36

If 82.6 g (0.8 mole) of diethylenetriamine are employed similarly to Example 35, 249 g (94.8% of theory) of a pale brownish, viscous oil are obtained.

"$C_{86}H_{112}N_{12}$ (1,313.9)": Calculated: C,78.62%; H,8.59%; N,12.79%. Found: C,78.85%; H,8.67%, N,12.52%.

The following—partly benzylated—polyamines are also obtained as yellowish, viscous oils by the procedure of Examples 35 and 36, using benzyl chloride not subjected to a condensation reaction:

| Example | Amine | Benzyl chloride | NaOH | Polybenzylamine |
|---|---|---|---|---|
| 37 | Triethylenetetramine | 4 moles | 4 moles | 496 g (97.9% of theory) |
| | | $C_{34}H_{42}N_4$ (506.7) | | |
| Calculated | C 80.59% | H 8.36% | N 11.06% | |
| Found | 80.72 | 8.47 | 10.89 | |
| 38 | Bis-(3-aminopropyl)-amine | 3 moles | 3 moles | 394 g (98.1% of theory) |
| | | $C_{27}H_{35}N_3$ (401.6) | | |
| Calculated | C 80.75% | H 8.78% | N 10.46% | |
| Found | 80.56 | 8.67 | 10.31 | |
| 39 | Pentaethylene hexamine | 4 moles | 4 moles | 585 g (98.7% of theory) |
| | | $C_{38}H_{52}N_6$ (592.9) | | |
| Calculated | C 76.99% | H 8.84% | N 14.18% | |
| Found | 77.13 | 8.69 | 13.98 | |

USE EXAMPLES

EXAMPLE 40

Testing the Corrosion-Inhibiting Action in Hydrochloric Acid (Acidizing)

The tests were carried out under the following conditions: the corrosion inhibitor is dissolved or dispersed in hydrochloric acid, if appropriate in combination with an acetylene alcohol. It is advisable in this connection to prepare beforehand a formulation composed of a solvent miscible with water or hydrochloric acid and a surfactant. Preferred solvents are lower alcohols, ketones or glycols and also dimethylformamide, formamide, acetonitrile and N-methylpyrrolidone. A greased steel test coupon is put into the hydrochloric acid. After 6 hours, the loss in weight of the coupon is determined and is converted into a rate of erosion of the surface.

TABLE 1

Temperature: 70° C.
Pressure: 1 bar
Type of steel: K 50
(acidizing inhibitors)

| Compound according to Example | Concentration [ppm] | Concentration of propargyl alcohol [ppm] | Strength of acid [%] | Erosion [μm/h] |
|---|---|---|---|---|
| 21 | 670 | 500 | 15 | 0,139 |
| 22 | 670 | 500 | 15 | 0,247 |
| 27 | 670 | 500 | 15 | 0,193 |
| 28 | 670 | 500 | 15 | 0,404 |
| 31 | 670 | 500 | 15 | 0,049 |
| 31 | 670 | 500 | 30 | 0,181 |
| 32 | 670 | 500 | 15 | 0,050 |
| 32 | 670 | 500 | 30 | 0,127 |
| 33 | 670 | 500 | 15 | 0,056 |
| 37 | 670 | 500 | 15 | 0,097 |
| 37 | 670 | 500 | 30 | 5,323 |
| 38 | 670 | 500 | 15 | 0,172 |
| 39 | 670 | 500 | 15 | 0,210 |
| Comparison | — | 500 | 15 | 0,135 |
| | | | 30 | Test coupon dissolved after 1 hour |

EXample 41

(Refinery Inhibitors)

A 2 L two-necked flask is equipped with a 400 ml Soxhlet extractor and a reflux condenser. A further glass tube into which taps for dropwise addition of the inhibitor solution are fitted is mounted between the extractor and the reflux condenser. Pairs of 2 metal coupons of ST 37 steel are suspended so that two are located in the Soxhlet extractor, that is to say in the liquid phase, and two in the gas space below the points for the dropwise addition of inhibitor solution The last pair of coupons is placed so that the inhibitor solution drips directly onto the coupons.

Approx. 1 l of a mixture composed of aromatic and aliphatic hydrocarbons, for example diesel oil, kerosene, petrol or artificially prepared mixtures, 100 ml of water saturated with $H_2S$ and 20 ml of 30% strength hydrochloric acid is then placed in the flask. The mixture is heated and, when it begins to boil, the inhibitor solution is added dropwise at a dripping rate of approx. 0.4 ml per minute. The inhibitor solution is a hydrocarbon in which the active compound is dissolved at a concentration of 50–1,000 ppm The test run is complete after about 4 hours; the coupons are evaluated gravimetrically and compared with the blank value.

TABLE 2

(Refinery inhibitors)

| Product according to Example | Structure/composition | % protection, 0.01% strength solution Gas phase | Liquid phase |
|---|---|---|---|
| — | Tetrabenzylethylenediamine | 72 | 43 |
| — | Pentabenzyldiethylenetriamine | 82 | 84 |
| | | 95 | 94 |
| — | Hexabenzyltriethylenetetramine | 88 | 75 |
| 38 | Tribenzyl-bis-(3-aminopropyl)-amine | 77 | 74 |
| — | Tetrabenzyl-bis-(3-aminopropyl)-amine | 84 | 77 |
| — | Tetrabenzyl-bis-(3-aminopropyl)-methylamine | 89 | 88 |
| | 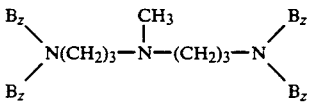 | | |
| | Tribenzyl (aminoethyl)-piperazine | 80 | 32 |
| | 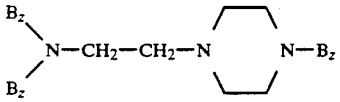 | | |

Example 42

Test as a Corrosion Inhibitor for Copper

Bright, degreased samples of copper were used for the corrosion test. Artificial sea water as specified in ASTM D665-IP135, to which the substance to be examined had been added, was used as the test solution. During the period of the test, 7.5 hours, the metal samples were completely immersed in the test solution, which was heated to 55° C. and into which air was introduced at approx. 100 ml/minute.

After the test the samples were cleansed for 15 seconds in half-concentrated hydrochloric acid and were washed with water and acetone. The dry metal samples were weighed before and after the test. The percentage protective action S, relative to a blank sample, was calculated from the loss in weight as follows:

$$S = \frac{m - m_1}{m} + 100,$$

where m = loss in weight of the metal sample without inhibitor, (blank sample) and $m_1$ = loss in weight of the metal sample with inhibitor.

The results of percentage protective action are shown in Table 3.

TABLE 3

(Corrosion inhibitors for copper)

| Corrosion inhibitor | Concentration in mg/l | % protective action S |
|---|---|---|
| None | — | 0 |
| Compound of Example 9 | 50 | 91.3 |
| Compound of Example 11 | 50 | 91.3 |
| Compound of Example 12 | 50 | 78.9 |
| Compound of Example 15 | 50 | 80.9 |
| Compound of Example 16 | 50 | 82.9 |
| Compound of Example 22 | 50 | 96.9 |
| Compound of Example 23 | 50 | 96.0 |
| Compound of Example 24 | 50 | 95.0 |
| Compound of Example 25 | 50 | 81.9 |
| Comparison: | | |
| Pentaethylenehexamine | 50 | 0 |
| Bis-(3-aminopropyl)amine | 50 | 0 |

Example 43

Test as a Corrosion Inhibitor for Iron

Bright, degreased metal samples of plain steel RST 14-03 as specified in DIN 1623 were kept for 24 hours in corrosive water as specified in ASTM D1384–70. Air was passed, at a rate of approx. 100 ml/minute, through the test solution containing the substance to be examined. The temperature of the test was 20° C. The pH of the test solution was 7–8 and it was adjusted, if necessary, with dilute sodium hydroxide solution or dilute sulphuric acid.

After the test, the metal samples were cleansed for 15 seconds in half-concentrated hydrochloric acid and were washed with water and acetone. The dry metal samples were weighed before and after the test. The percentage protective action S, relative to a blank sample, was calculated from the loss in weight. The results are shown in Table 4.

TABLE 4

(Corrosion inhibitors for iron)

| Corrosion inhibitor | Concentration in mg/l | % protective action S |
|---|---|---|
| None | — | 0 |
| Compound from Example 11 | 500 | 91.3 |
| Compound from Example 21 | 500 | 97.6 |
| Compound from Example 22 | 500 | 97.2 |
| Compound from Example 23 | 500 | 88.1 |
| Compound from Example 24 | 500 | 96.7 |
| Compound from Example 25 | 500 | 92.6 |
| Compound from Example 26 | 500 | 95.6 |
| Compound from Example 28 | 500 | 93.5 |

Example 44

Test as a Corrosion Inhibitor in Acids

The losses in weight of samples of plain steel RST 14-03 in 10% strength hydrochloric acid and in 10% strength sulphuric acid were determined. The temperature of the acid was 50° C. and the duration of the test was 3 hours.

The percentage protective action S was calculated by comparing the losses in weight in acid with and without inhibitor according to the equation stated in Example 42. The results are shown in Tables 5 and 6.

TABLE 5

(Corrosion inhibitors in hydrochloric acid)
Test solution: 10% strength HCl

| Corrosion inhibitor | Concentration in % by weight | % protective action S |
|---|---|---|
| None | — | 0 |
| Compound from Example 9 | 0.05 | 98.0 |
| Compound from Example 10 | " | 96.6 |
| Compound from Example 11 | " | 98.6 |
| Compound from Example 12 | " | 98.3 |
| Compound from Example 13 | " | 97.4 |
| Compound from Example 14 | " | 91.0 |
| Compound from Example 15 | " | 98.9 |
| Compound from Example 16 | " | 98.6 |
| Compound from Example 17 | " | 97.2 |
| Compound from Example 18 | " | 98.1 |
| Compound from Example 19 | " | 98.6 |
| Compound from Example 20 | " | 97.6 |
| Compound from Example 21 | " | 98.8 |
| Compound from Example 22 | " | 98.0 |
| Compound from Example 23 | " | 98.0 |
| Compound from Example 24 | " | 97.6 |
| Compound from Example 25 | " | 97.6 |
| Compound from Example 26 | " | 97.0 |
| Compound from Example 27 | " | 98.8 |
| Compound from Example 28 | " | 97.6 |
| Compound from Example 29 | " | 99.0 |
| Compound from Example 30 | " | 99.5 |
| Compound from Example 31 | " | 99.9 |
| Compound from Example 32 | " | 99.9 |
| Compound from Example 33 | " | 99.9 |
| Compound from Example 34 | " | 99.6 |
| Compound from Example 35 | " | 99.5 |
| Compound from Example 36 | " | 99.5 |
| Compound from Example 38 | " | 97.2 |
| Compound from Example 39 | " | 97.5 |
| Comparison: | | |
| Ethylenediamine | 0.05 | 39.6 |
| Diethylenetriamine | " | 47.8 |
| Triethylenetetramine | " | 70.5 |
| Tetraethylenepentamine | " | 78.0 |
| Pentaethylenehexamine | " | 79.6 |
| Bis-(3-aminopropyl)-amine | " | 53.0 |
| Pentamethyldiethylenetriamine | " | 38.6 |

TABLE 6

(Corrosion inhibitors in sulphuric acid)
Test solution: 10% strength $H_2SO_4$

| Corrosion inhibitor | Concentration in % by weight | % protective action S |
|---|---|---|
| None | — | 0 |
| Compound from Example 11 | 0.05 | 89.6 |
| Compound from Example 29 | " | 90.0 |
| Compound from Example 32 | " | 87.0 |
| Compound from Example 33 | " | 90.3 |
| Compound from Example 36 | " | 87.0 |
| Compound from Example 37 | " | 89.2 |
| Compound from Example 38 | " | 98.7 |
| Compound from Example 39 | " | 99.0 |

What is claimed is:

1. In the method of protecting metals from corrosion wherein an effective amount of a corrosion inhibiting agent is added to the liquid medium with which said metals are in contact, the improvement which comprises using as the corrosion inhibiting agent a polyaralkylamine of the formula

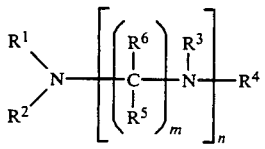

wherein $R^1$ to $R^4$ are linked to one another in such manner that $C_1$–$C_{18}$-alkyl, benzyl, α-methylbenzyl, α,α-dimethylbenzyl, 4-methylbenzyl and tert.-butylbenzyl, or polybenzyl, poly α-methylbenzyl, poly α, α-dimethylbenzyl, poly 4-methylbenzyl and poly tert.-butyl benzyl or $C_6$–$C_{15}$-aryl, or $R^1$ to $R^4$ are linked to one another in such amnner that in each case two of the radicals, together with the nitrogen atom linking them or together with the N-C-containing remainder of the chain, form a 5-membered to 6-membered ring, at least one of the radicals $R^1$ to $R^4$ denoting benzyl, α-methylbenzyl, α,α-dimethylbenzyl, 4-methylbenzyl and tert.-butylbenzyl, or polybenzyl, poly α-methylbenzyl, poly α-α-dimethylbenzyl, poly 4-methylbenzyl and poly tert.-butyl benzyl, and $R_5$ and $R_6$ independently of one another are hydrogen, $C_1$–$C_6$-alkyl, $C_5$–$C_7$-cycloalkyl, $C_7$–$C_{12}$-aralkyl or $C_6$–$C_{10}$-aryl, m is an integer from 2 to 10, and n is an integer from 2 to 30, and the C-chain defined by m can contain different radicals $R^5$ and $R^6$ and the C-N chain defined by n can have different values of m.

2. The method of claim 1 wherein the polyaralkylamine is employed in an amount of 0.001 to 3% by weight, relative to the medium having a corrosive action.

* * * * *

UNITED STATES PATENT AND TRADEMARK OFFICE
CERTIFICATE OF CORRECTION

PATENT NO. : 5,059,391

DATED : October 22, 1991

INVENTOR(S) : Botta et al.

It is certified that error appears in the above-identified patent and that said Letters Patent is hereby corrected as shown below:

| | |
|---|---|
| Title Page | OTHER PUBLICATIONS: Lines 6-7 delete " Publication of Nace, Ban 37, Nr. 5 Mai 1981 M. Duprat et al.// " , line 8 after " Official " insert -- Publication of Nace, Band 37, Nr. 5, Mai 1981 M. Duprat et al. -- |
| Col. 1, line 64 | Delete " i$obutyl " and substitute -- isobutyl -- |
| Col. 3, line 34 | Delete " hexaethyleneheplamine " and substitute -- hexaethyleneheptamine -- |
| Col. 4, line 61 | Delete " uni " and substitute -- unit or -- |
| Col. 8, next to last line | Delete " pol " and substitute -- poly -- |
| Col. 10, line 21 | Delete " yl " |
| Col. 10, line 25 | Delete " 35 " |
| Col. 11, line 21 | After " (676.4). " insert -- Calculated: C,76.35%; H, 8.05%; Cl,5.24%; N,10.35%. -- |
| Col. 12, line 13 | Delete " N,10.12. " and substitute -- N,10.31%. Found: C,75.30%; H,7.81%; Cl,6.37%; N,10.12. -- |
| Col. 13, line 44 | Delete " Cl,6.3% " and substitute -- Cl,6.53% -- |
| Col. 14, line 21 | Delete " C,78.789% " and substitute -- C,78.89% -- |
| Col. 14, line 48 | Delete " Example 20 " and substitute -- Example 30 -- |
| Col. 14, line 59 | Delete " AFter " and substitute -- after -- |

UNITED STATES PATENT AND TRADEMARK OFFICE
CERTIFICATE OF CORRECTION

PATENT NO. : 5,059,391

DATED : October 22, 1991

INVENTOR(S) : Botta et al.

It is certified that error appears in the above-identified patent and that said Letters Patent is hereby corrected as shown below:

| | |
|---|---|
| Col. 15, line 14 | Delete " tetraehtylenepentamine " and substitute -- tetraethylenepentamine -- |
| Col. 15, line 54 | Delete " $H_{20}$ " and substitute -- $H_2O$ -- |
| Col. 15, line 58 | Delete " $C_{82}H_{99}N9$ " and substitute -- $C_{82}H_{99}N_9$ -- |
| Col. 15, line 60 | Delete " N,10.634% " and substitute -- N,10.63% -- |
| Col. 16, lines 40-41 | Delete " formaimide " and substitute -- formamide -- |
| Col. 17, line 1 | Delete " EXample 41 " and substitute -- Example 41 -- |
| Col. 20, claim 1 line 9 | After " are " delete " linked to one another in such manner that " and substitute -- indentical or different and are hydrogen -- |

UNITED STATES PATENT AND TRADEMARK OFFICE

CERTIFICATE OF CORRECTION

PATENT NO. : 5,059,391

DATED : October 22, 1991

INVENTOR(S) : Botta et al

It is certified that error appears in the above-identified patent and that said Letters Patent is hereby corrected as shown below:

Col. 20, claim 1, line 39, Delete "5-membered to 6-membered ring, at least one of the " and substitute -- 5-membered to 6-membered ring, at least one of the --.

Signed and Sealed this

Twenty-second Day of June, 1993

*Attest:*

Michael K. Kirk

MICHAEL K. KIRK

*Attesting Officer*

*Acting Commissioner of Patents and Trademarks*